US011885109B2

(12) United States Patent
Imaizumi

(10) Patent No.: US 11,885,109 B2
(45) **Date of Patent: *Jan. 30, 2024**

(54) WASHDOWN FLUSH TOILET

(71) Applicant: TOTO LTD., Kitakyushu (JP)

(72) Inventor: Shoko Imaizumi, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/206,035

(22) Filed: Mar. 18, 2021

(65) Prior Publication Data

US 2021/0301513 A1 Sep. 30, 2021

(30) Foreign Application Priority Data

Mar. 30, 2020 (JP) ..... 2020-059717

(51) Int. Cl.
*E03D 11/08* (2006.01)
*E03C 1/284* (2006.01)

(52) U.S. Cl.
CPC ..... *E03D 11/08* (2013.01); *E03C 1/284* (2013.01)

(58) Field of Classification Search
CPC ..... E03D 11/08; E03C 1/284
USPC ..... 4/420
See application file for complete search history.

(56) References Cited

U.S. PATENT DOCUMENTS 9,157,225 B2 * 10/2015 Kashirajima ..... E03D 11/08
2016/0273207 A1 * 9/2016 Saito ..... E03D 11/17
2017/0241119 A1 * 8/2017 Matsuo ..... E03D 11/08
2018/0195262 A1 * 7/2018 Hashimoto ..... E03D 11/02
2019/0345707 A1 * 11/2019 Kuroki ..... E03D 11/08
2020/0063425 A1 * 2/2020 Shinomiya ..... E03D 11/16

FOREIGN PATENT DOCUMENTS

JP 2014-051883 A 3/2014
JP 2016-176320 A 10/2016
JP 2017-145631 A 8/2017
JP 2018-112004 A 7/2018

OTHER PUBLICATIONS

An Office Action mailed by the Japanese Patent Office dated Jul. 26, 2021, which corresponds to Japanese Patent Application No. 2020-059717 and is related to U.S. Appl. No. 17/206,035.

* cited by examiner

*Primary Examiner* — David P Angwin
*Assistant Examiner* — William R Klotz
(74) *Attorney, Agent, or Firm* — Studebaker & Brackett PC

(57) ABSTRACT

In a washdown flush toilet, a water discharge trap conduit includes: an inlet pipe part connected to a bowl part receiving waste; a trap ascending pipe part connected to the inlet pipe part and forming an ascending flow channel; and a trap descending pipe part connected to the trap ascending pipe part and forming a descending flow channel. With regard to a cross section perpendicular to a flow direction of the ascending flow channel, a portion on a downstream side of the ascending flow channel is provided with an enlarged part having a cross section area larger than that on an upstream side of the ascending flow channel. A downstream end of the ascending flow channel and/or an upstream side of the descending flow channel is provided with a shrunk part having a cross section area smaller than that on the upstream side of the ascending flow channel.

4 Claims, 7 Drawing Sheets

WASHDOWN FLUSH TOILET

TECHNICAL FIELD

The present invention pertains to a washdown flush toilet, and more particularly to a washdown flush toilet which has excellent water saving performance.

BACKGROUND ART

Conventionally, as one type of flush toilet, a washdown flush toilet has been known wherein the washdown flush toilet adopts a principle that waste is washed away by a flow of water caused by the water's falling down.

For example, JP-A-2016-176320 has disclosed a washdown flush toilet in which a protruding part is provided at a water discharge socket connected to a water discharge trap conduit in order to prevent a siphon phenomenon in a conduit under a floor. JP-A-2018-112004 has disclosed a washdown flush toilet in which a bottom surface at an upstream end of a trap descending pipe part of a water discharge trap conduit is made into a descending sloped surface.

Waste (such as excrement or toilet paper) discharging performance of a washdown flush toilet mainly depends on a water level difference of a reserved water in a bowl part when the washdown flush toilet is operated (flushed). More specifically, waste discharging performance is determined dependent on a water level difference between a water level of the reserved water before a flushing operation and a highest water level of the reserved water when flush water has been supplied by the flushing operation. In general, when the water level difference is greater, the waste discharging performance is also greater.

PATENT DOCUMENT LIST

Patent Document 1: JP-A-2016-176320
Patent Document 2: JP-A-2018-112004

SUMMARY OF INVENTION

Technical Problem

Recently, in a flush toilet, water saving performance has been requested to be further improved. However, in a washdown flush toilet, when an amount of flush water is reduced, a water level difference is also reduced to be not sufficient, and thus waste discharging performance is deteriorated.

Herein, in general, a water discharge trap conduit includes: an inlet pipe part whose one end is continuous or connected to a lower portion of a bowl part; a trap ascending pipe part whose one end is continuous or connected to the other end of the inlet pipe part and which forms an ascending flow channel; and a trap descending pipe part whose one end is continuous or connected to the other end of the trap ascending pipe part and which forms a descending flow channel.

As shown in FIG. 9, a conventional trap ascending pipe part has a substantially constant cross section area of an ascending flow channel, with regard to a cross section perpendicular to a flow direction of the ascending flow channel. In such a conventional trap ascending pipe part, when an amount of flush water is reduced, there is possibility that waste cannot climb up the trap ascending pipe part, but may return to an inlet pipe part.

Thus, in a washdown flush toilet, for the purpose of improving waste discharging performance while saving an amount of flush water, there is room for improvement in a shape of a water discharge trap conduit, in particular in a shape of a flow channel in a trap ascending pipe part.

The present invention has been made under the above background. The object of the present invention is to provide a washdown flush toilet which can maintain effective waste discharging performance even with a relatively smaller amount of flush water.

Solution to Problem

The present invention is a washdown flush toilet including: a bowl part configured to receive waste; and a water discharge trap conduit connected to a lower portion of the bowl part; wherein the water discharge trap conduit includes: an inlet pipe part whose one end is continuous or connected to the lower portion of the bowl part; a trap ascending pipe part whose one end is continuous or connected to the other end of the inlet pipe part and which forms an ascending flow channel; and a trap descending pipe part whose one end is continuous or connected to the other end of the trap ascending pipe part and which forms a descending flow channel; with regard to a cross section perpendicular to a flow direction of the ascending flow channel, a portion on a downstream side of the ascending flow channel is provided with an enlarged part which has a cross section area larger than that on an upstream side of the ascending flow channel; and a downstream end of the ascending flow channel and/or an upstream side of the descending flow channel is provided with a shrunk part which has a cross section area smaller than that on the upstream side of the ascending flow channel.

According to the above feature, when the washdown flush toilet is operated (flushed), flush water along with waste flows into the trap ascending pipe part of the water discharge trap conduit, and separation of the waste (breakup of a mass) is promoted in the enlarged part whose cross section area is larger. Subsequently, in the shrunk part whose cross section area is smaller, the waste and the flush water which have been spread in the enlarged part are collected again to effectively flow. According to these actions, effective waste discharging performance can be maintained even with a relatively smaller amount of flush water.

In addition, it is preferable that the enlarged part is enlarged on an upper side of the ascending flow channel.

According to the above feature, when the washdown flush toilet is operated (flushed) and the flush water along with the waste flows into the trap ascending pipe part of the water discharge trap conduit, a part of the flush water flows into an upper enlarged area of the enlarged part whose cross section area is larger (enlarged) on the upper side. Due to this action of the flush water, the waste passing the enlarged part can be given a rotational force, so that the waste can rotate in such a direction (vertical rotational direction) that the waste can climb up a highest reachable position in the ascending flow channel. According to these actions, the waste discharging performance can be enhanced more even with a relatively smaller amount of flush water.

If an upstream end of a top surface of the enlarged part is located below a highest reachable position of a bottom surface of the ascending flow channel, the waste passing the enlarged part can be given the rotational force more effectively. On the other hand, if the upstream end of the top surface of the enlarged part is located above the highest reachable position of the bottom surface of the ascending flow channel, the cross section area of the ascending flow channel can be maintained constant (or less than constant) for a longer region of the ascending flow channel, so that potential energy by the flush water's falling down may be used more efficiently (with less loss).

In addition, it is preferable that a flow channel height of the shrunk part is lower than a flow channel height on the upstream side of the ascending flow channel. That is to say, it is preferable that the cross section area of the shrunk part is shrunk in a vertical direction.

According to the above feature, the direction in which the cross section area is enlarged in the enlarged part and the direction in which the cross section area is shrunk in the shrunk part are the same, so that the waste and the flush water which have been spread in the enlarged part are effectively collected in the shrunk part to smoothly flow. This also contributes to the enhancement of the waste discharging performance.

In addition, it is preferable that, at least a portion of the top surface of the enlarged part of the ascending flow channel is formed by a wall surface extending in a substantially vertical direction.

According to the findings of the inventors of the present invention, when the enlarged part is formed in the above manner, the rotational force can be given more effectively, In addition, it is preferable that, with regard to the cross section perpendicular to the flow direction of the ascending flow channel, at least a portion of the top surface of the enlarged part of the ascending flow channel has a convex upward shape.

According to the above feature, even though the cross section area of the ascending flow channel is larger in the enlarged part, it can be effectively prevented that the flow of the flush water and the waste in the enlarged part is disturbed excessively.

In this case, it is more preferable that, with regard to the cross section perpendicular to the flow direction of the ascending flow channel or the descending flow channel, at least a portion of a top surface of the shrunk part has a convex upward shape.

According to the above feature, a top surface of the ascending flow channel (and the descending flow channel) can be smoothly formed from the enlarged part to the shrunk part, so that the waste and the flush water which have been spread in the enlarged part can be effectively collected to smoothly flow. This also contributes to the enhancement of the waste discharging performance.

In addition, it is preferable that, with regard to a cross section perpendicular to a flow direction of the descending flow channel, a portion on a downstream side of the descending flow channel is provided with a second enlarged part which has a cross section area larger than that of the enlarged part.

According to the above feature, it is possible to prevent a siphon phenomenon in the descending flow channel.

Advantageous Effects of Invention

According to one feature of the present disclosure, it is possible to provide a washdown flush toilet which can maintain effective waste discharging performance even with a relatively smaller amount of flush water.

DESCRIPTION OF EMBODIMENTS

<Entire Structure>

Figure 1:
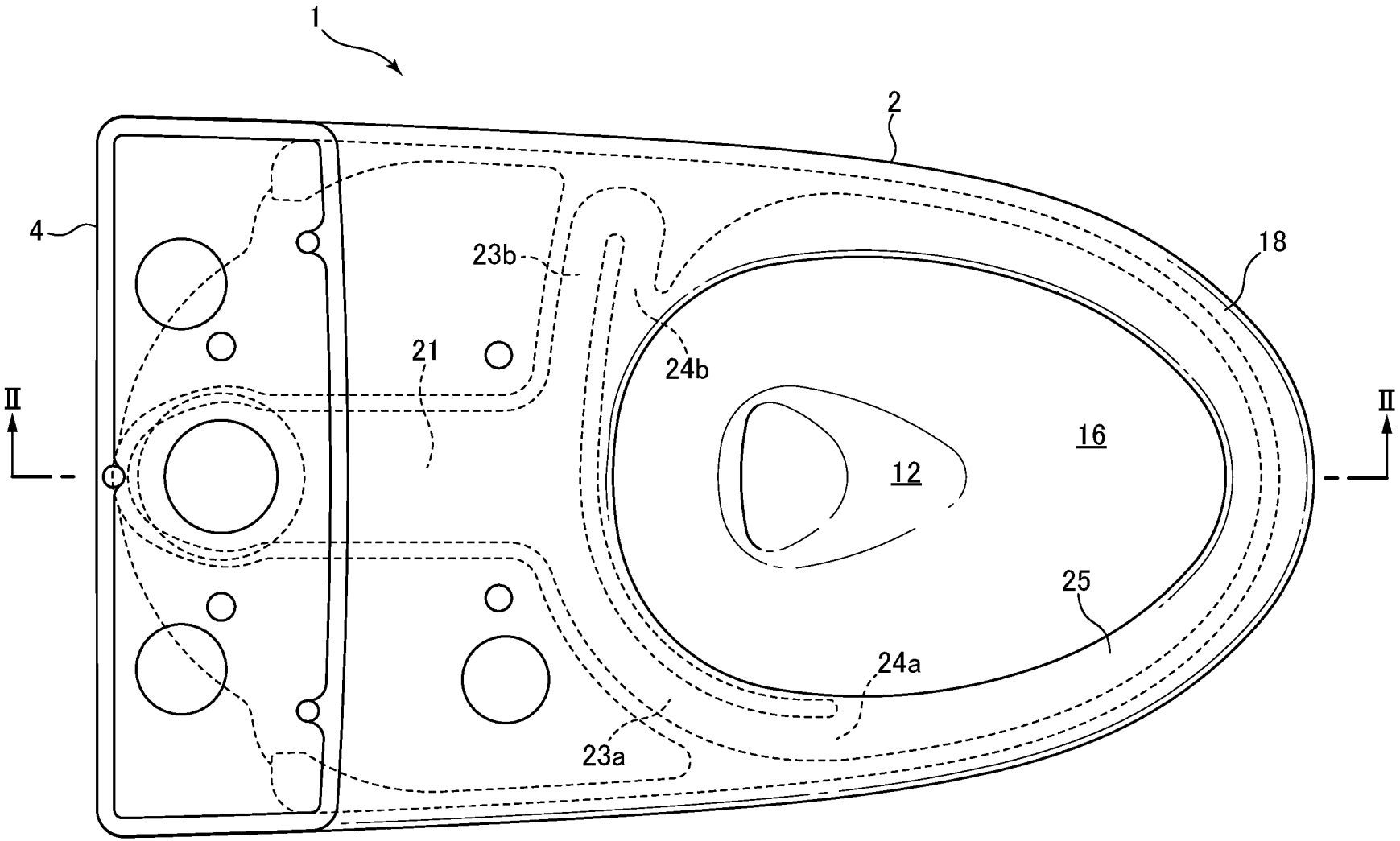
FIG. 1 is a plan view showing a washdown flush toilet according to an embodiment of the present invention.
Figure 2:
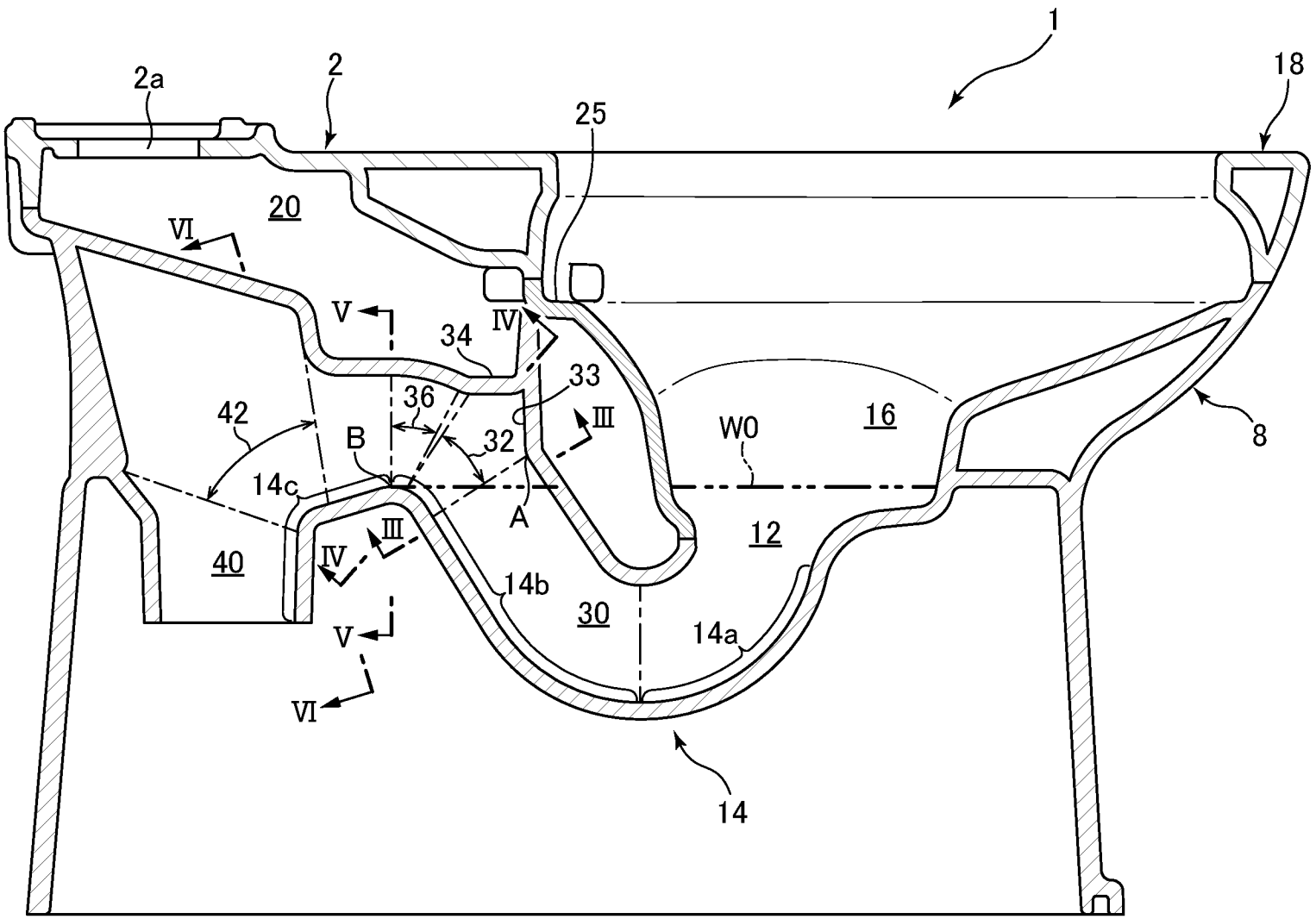
FIG. 2 is a cross section view taken along line II-II of FIG. 1 (although the reservoir tank 4 is omitted)
Figure 3:
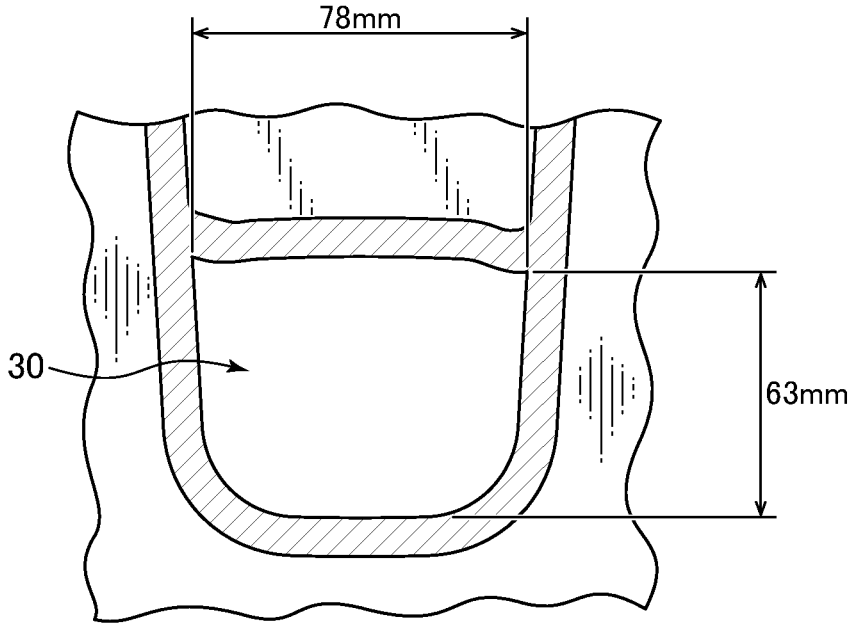
FIG. 3 is a cross section view taken along line III-III of FIG. 2.
Figure 4:
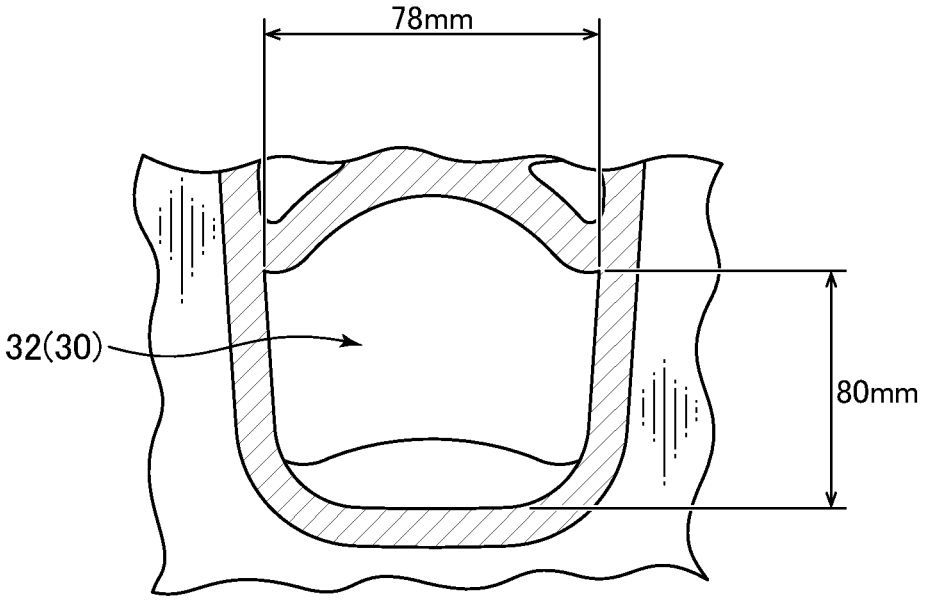
FIG. 4 is a cross section view taken along line IV-IV of FIG. 2.
Figure 5:
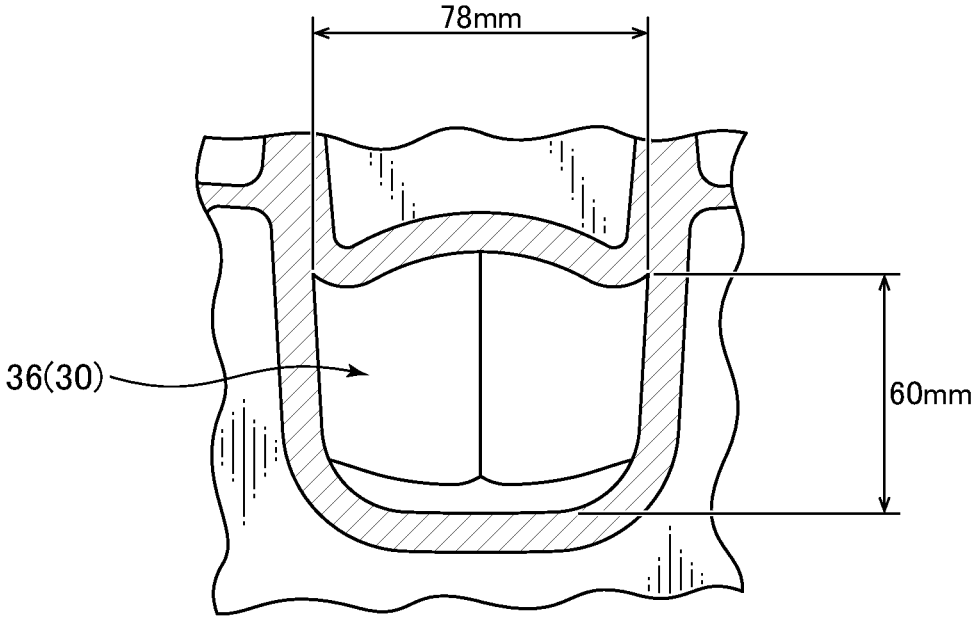
FIG. 5 is a cross section view taken along line V-V of FIG. 2.
Figure 6:
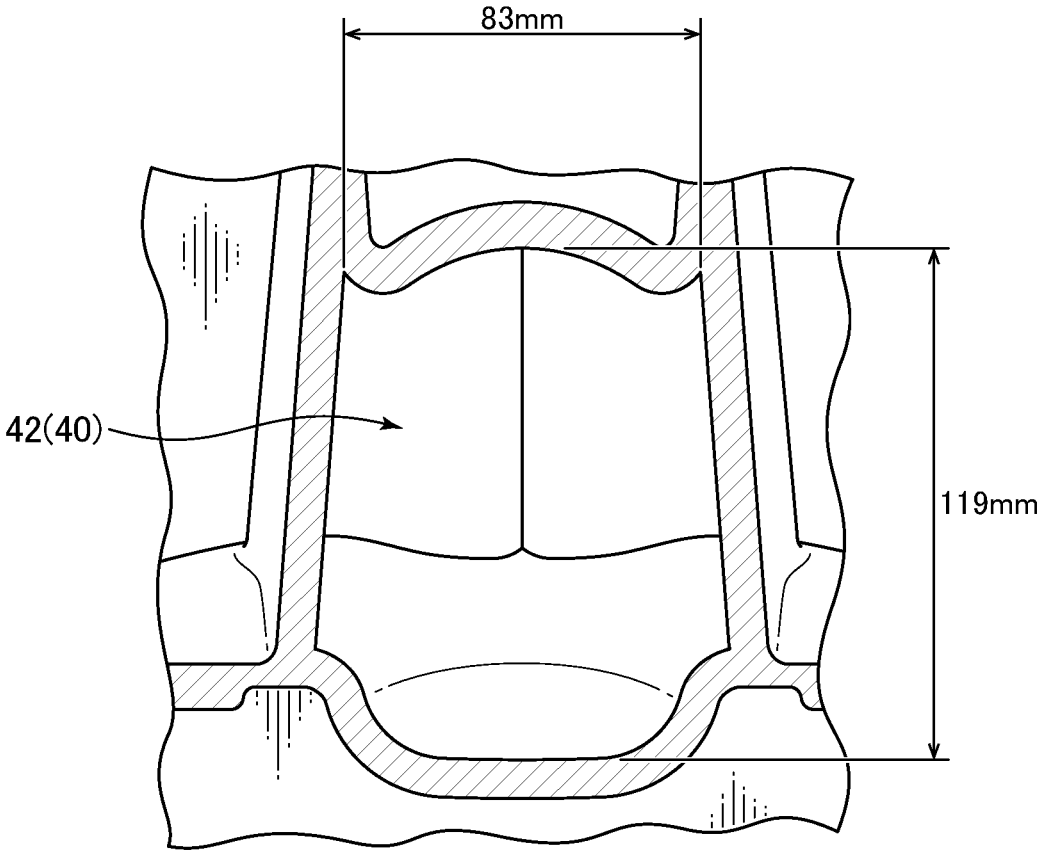
FIG. 6 is a cross section view taken along line VI-VI of FIG. 2.
Figure 7:
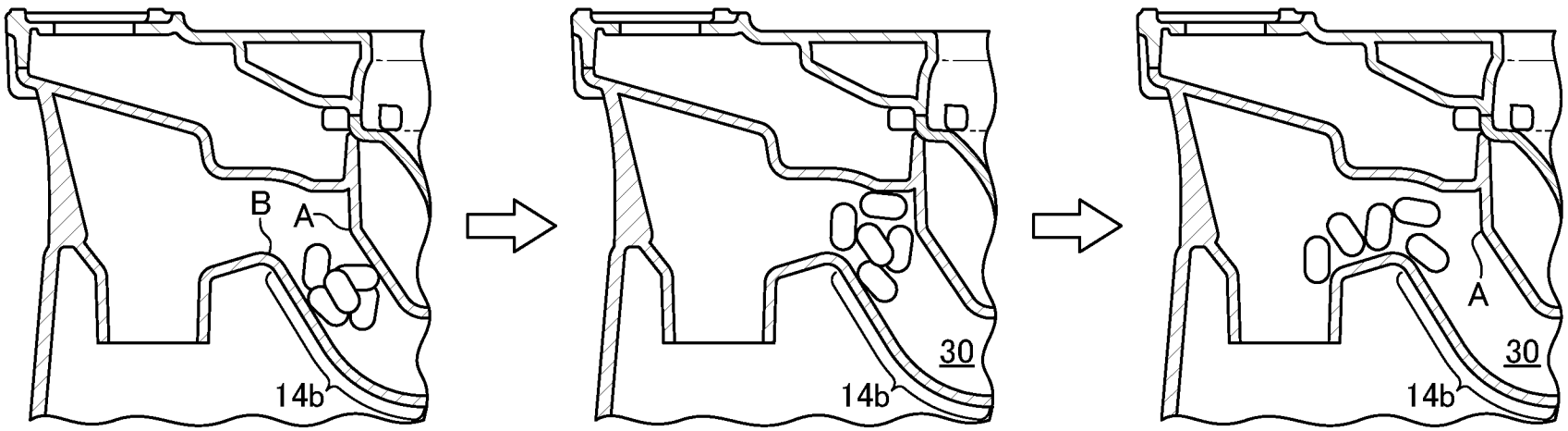
FIG. 7 is an explanatory view showing an action of the washdown flush toilet according to the present embodiment.
Figure 8:
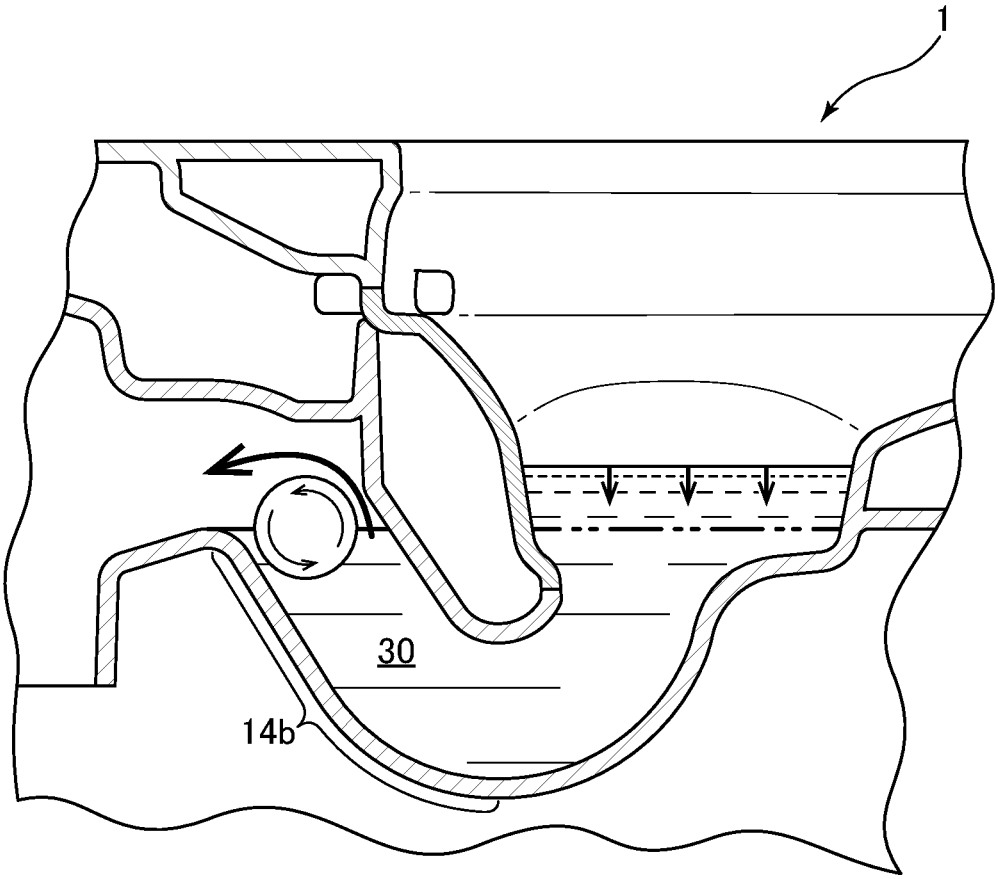
FIG. 8 is an explanatory view showing another action of the washdown flush toilet according to the present embodiment.
Figure 9:
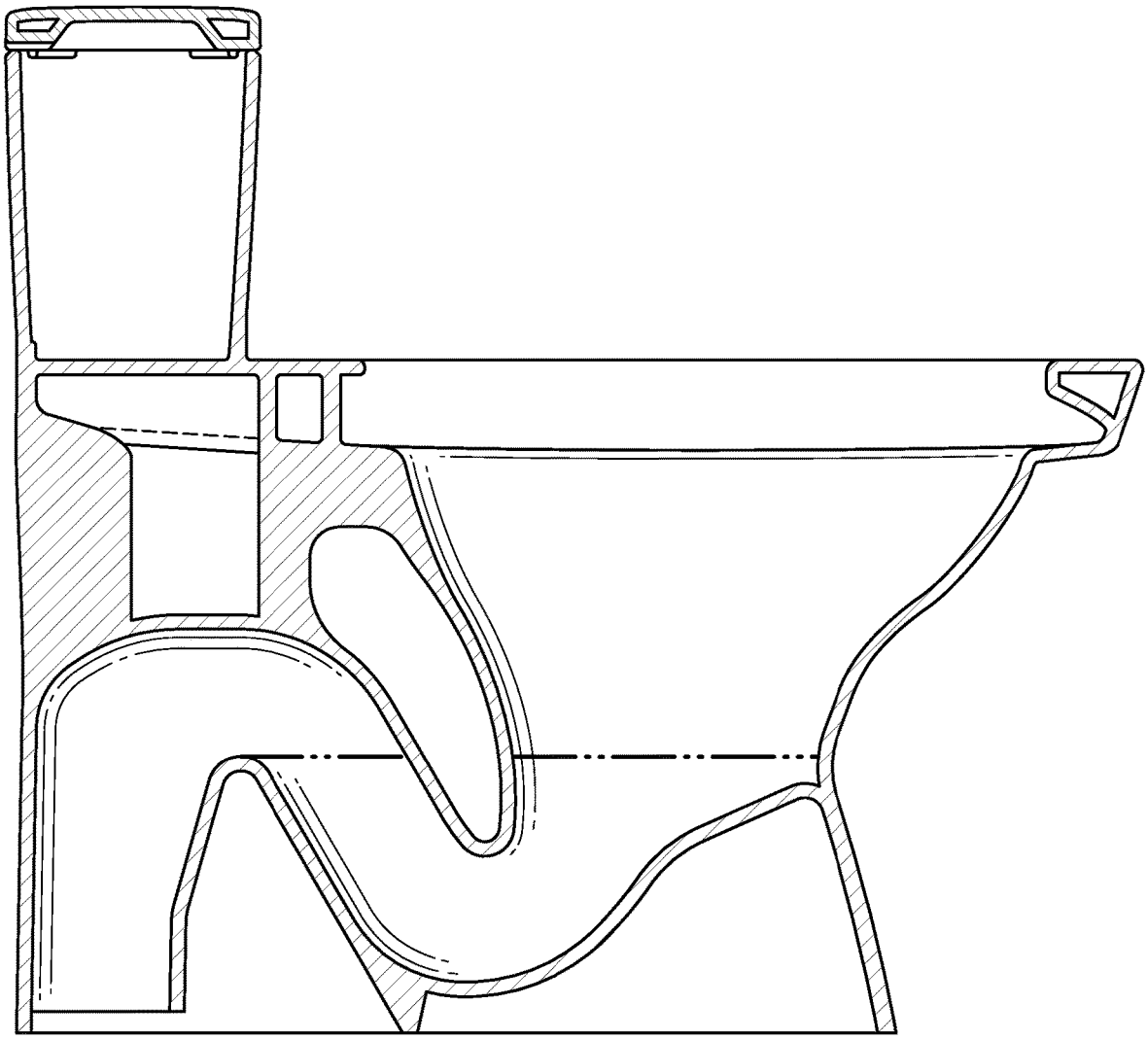
FIG. 9 is an explanatory view showing a shape of an ascending flow channel of a conventional trap ascending pipe part.

With reference to the attached drawings, we explain a washdown flush toilet according to an embodiment of the present invention. FIG. 1 is a plan view showing a washdown flush toilet according to an embodiment of the present invention. FIG. 2 is a cross section view taken along line II-II of FIG. 1 (although the reservoir tank 4 is omitted). FIG. 3 is a cross section view taken along line III-III of FIG. 2. FIG. 4 is a cross section view taken along line IV-IV of FIG. 2. FIG. 5 is a cross section view taken along line V-V of FIG. 2. FIG. 6 is a cross section view taken along line VI-VI of FIG. 2. FIG. 7 is an explanatory view showing an action of the washdown flush toilet according to the present embodiment. FIG. 8 is an explanatory view showing another action of the washdown flush toilet according to the present embodiment. FIG. 9 is an explanatory view showing a shape of an ascending flow channel of a conventional trap ascending pipe part.

As shown in FIGS. 1 to 7, the washdown flush toilet 1 according to the present embodiment has a toilet main unit 2 made of porcelain or the like. A reservoir tank 4 as a flush water tank is provided above a rear side of the toilet main unit 2. The reservoir tank 4 is connected to a water supply source (not shown) such as a public water system.

In the following description, It should be noted that the present embodiment will be described based on the following assumption: a "right side" is defined when viewing the toilet main unit 2 rearwardly from a front side thereof; and a "left side" is also defined when viewing the toilet main unit 2 rearwardly from the front side thereof.

When an operation lever or button (not shown) provided on the reservoir tank 4 is operated, a flushing operation is started. Specifically, when the operation lever or button is operated, a discharge valve (not shown) provided in the reservoir tank 4 is opened. Then, a predetermined amount of the flush water is supplied from the reservoir tank 4 into the main toilet unit 2 through a supply port 2*a* provided on the rear side of the main toilet unit 2.

Herein, the predetermined amount of the flush water is about 3.8 liters to 6.0 liters, which is smaller than the amount of the flush water (for example, about 13 liters) of a conventional typical washdown flush toilet.

Instead of the reservoir tank 4, another type of water supply apparatus, such as a flush valve system, may be used for supplying the predetermined amount of the flush water.

A bowl portion 8 is formed on an upper side of a front portion of the main toilet unit 2. The bowl portion 8 has a waste receiving surface 16 formed in a bowl shape, and a rim portion 18 formed at an upper edge part of the bowl portion 8 and configured to guide and discharge (spout) the flush water toward the waster receiving surface 16.

In the present embodiment, the rim portion 18 is formed at substantially an entire circumference of the upper edge part of the bowl portion 8, and is formed in an overhanging shape toward the inside. In addition, a rim water-passage bottom surface 25 is formed in an inward shelf shape in a substantially flat horizontal manner over substantially the entire circumference of the bowl portion 8. According to this configuration, the flush water that flows on the rim water-passage bottom surface 25 can form a flow around substantially the entire circumference of the upper part of the bowl portion 8. As a result, the rim portion 18 can guide the flush water in a well-balanced manner to respective regions in the bowl portion 8.

Inside the main toilet unit 2, there is provided a water conduit 20 which is configured to guide the flush water supplied from the supply port 2*a* provided on the rear side of the main toilet unit 2 to the rim water-passage bottom surface 25 toward the bowl portion 8.

The water conduit 20 has: a main water-guiding portion 21, a first rim water-guiding portion 23*a*, a first spouting portion 24*a*, a second rim water-guiding portion 23*b* and a second spouting portion 24*b*.

As shown in FIG. 1, the main water-guiding portion 21 is formed from a position below the reservoir tank 4 toward the front portion of the main toilet unit 2. The main water-guiding portion 21 is branched into the first rim water-guiding portion 23*a* and the second rim water-guiding portion 23*b* on a downstream side. Thus, the flush water supplied into the main water-guiding portion 21 is guided to flow into the first rim water-guiding portion 23*a* and the second rim water-guiding portion 23*b*.

The first rim water-guiding portion 23*a* is formed along the rim portion 18 from the rear side of the bowl part 8 toward a left side of the main toilet unit 2. The first spouting portion 24*a* is formed at a downstream end of the first rim water-guiding portion 23*a* (for example, around a center in a front and back direction on the left side of the rim portion 18).

Thus, the flush water supplied form the main water-guiding portion 21 to the first rim water-guiding portion 23*a* flows in a counterclockwise direction in a plan view, and then flows from the first spouting portion 24*a* onto the rim water-passage bottom surface 25 to be spouted toward the waste receiving surface 16 of the bowl part 8.

The second rim water-guiding portion 23*b* is formed on the rear side of the bowl part 8, and has a bending portion which bends the flow direction of the flush water. The second spouting portion 24*b* is formed at a downstream end of the second rim water-guiding portion 23*b* (for example, at a rear portion on the right side of the rim portion 18).

Thus, the flush water supplied form the main water-guiding portion 21 to the second rim water-guiding portion 23*b* flows in a clockwise direction in a plan view, bends at the bending portion to flow in a counterclockwise direction in a plan view, and then flows from the second spouting portion 24*b* onto the rim water-passage bottom surface 25 to be spouted toward the waste receiving surface 16 of the bowl part 8.

As described above, the washdown flush toilet 1 according to the present embodiment is configured to spout the flush water from the first and second spouting portions 24*a*, 24*b* provided on the rim portion 18, and to generate a circulating (swirling) flow in the waste receiving surface of the bowl part 8 to wash the bowl part 8.

<Structure about Water Discharge Trap Conduit 14>

A water pooling region 12 is formed at a lower portion of the bowl part 8, and a predetermined amount of water is pooled in the water pooling region 12. An initial level of the pooled water is indicated by the sign WO. A lower end of the water pooling region 12 is continuous or connected to one end of an inlet pipe part 14*a* of a water discharge trap conduit 14. The pooled water functions as sealing water, i.e., it is prevented that a bad smell or the like flows back from the water discharge trap conduit 14 toward the bowl part 8.

The other end of the inlet pipe part 14*a* is continuous or connected to one end of a trap ascending pipe part 14*b*, which forms an ascending flow channel 30. The other end of the trap ascending pipe part 14*b* is continuous or connected to one end of a trap descending pipe part 14*c*, which forms a descending flow channel 40. The other end of the trap descending pipe part 14*c* continuous or connected to a water discharge pipe (not shown) provided on or under a floor surface.

As shown in FIG. 2, in a longitudinal section view, the bottom surface (lowermost surface) of the inlet pipe part 14*a* is formed in a convex downward shape, and the bottom surface of the trap ascending pipe part 14*b* in a region of an upstream end thereof is also formed in a convex downward shape, and both of them are smoothly continuous or connected to each other.

In addition, with regard to a cross section perpendicular to the flow direction of the inlet pipe part 14*a*, the bottom surface (lowermost surface) of the inlet pipe part 14*a* is formed in a convex downward shape.

In a substantially similar way, as shown in FIG. 2, in a longitudinal section view, the top surface (uppermost surface) of the inlet pipe part 14*a* is formed in a convex downward shape, and the top surface of the trap ascending pipe part 14*b* in the region of the upstream end thereof is also formed in a convex downward shape, and both of them are smoothly continuous or connected to each other.

In addition, with regard to a cross section perpendicular to the flow direction of the inlet pipe part 14*a*, the top surface (uppermost surface) of the inlet pipe part 14*a* is formed in a convex upward shape.

The left and right side surfaces of the inlet pipe part 14*a* and the left and right side surfaces of the trap ascending pipe part 14*b* in the region of the upstream end thereof are also smoothly continuous or connected to each other, respectively.

A middle region of the trap ascending pipe part 14*b* is in a straight tubular shape and extends diagonally upward. A cross section perpendicular to the flow direction of the ascending flow channel 30 in the middle region is constant, which is in a cross section shape shown in FIG. 3 (flow channel width is 78 mm, flow channel height is 63 mm).

In the present embodiment, in the region of the upstream end of the trap ascending pipe part 14*b* as well, the cross section perpendicular to the flow direction of the ascending flow channel 30 is constant, which is in the cross section shape shown in FIG. 3.

With regard to the cross section perpendicular to the flow direction of the ascending flow channel 30, a portion on a downstream side of the ascending flow channel 30 is provided with an enlarged part 32, which has a cross section area larger than that on an upstream side of the ascending flow channel 30 (the cross section area of the cross section shape shown in FIG. 3). The enlarged part 32 is enlarged on an upper side of the ascending flow channel 30. As shown in FIG. 2, an upstream end A of a top surface of the enlarged part 32 is located above a highest reachable position B of a bottom surface of the ascending flow channel 30 (height difference is about 15 mm).

More specifically, the top surface of the enlarged part 32 of the present embodiment consists of: a substantially vertical wall surface 33 extending in a substantially vertical direction from the upstream end A; and a substantially horizontal wall surface 34 extending in a substantially horizontal direction. The substantially vertical wall surface 33 is in a flat shape. The substantially horizontal wall surface 34 is formed in a convex upward shape at least at a central region in a right and left direction (see FIG. 4: flow channel width is 78 mm, flow channel maximum height is 80 mm), with regard to the cross section perpendicular to the flow direction of the ascending flow channel 30, in the same way as the top surface of the ascending flow channel 30 on the upstream side than the enlarged part 32 (see FIG. 3).

On the other hand, with regard to the cross section perpendicular to the flow direction of the ascending flow channel 30, the bottom surface of the enlarged part 32 of the present embodiment has a substantially constant cross section shape (see FIG. 4), which is substantially the same as the cross section shape of the bottom surface of the ascending flow channel 30 on the upstream side than the enlarged part 32 (see FIG. 3).

In addition, in the present embodiment, in a region of a downstream end of the ascending flow channel 30, a shrunk part 36 is formed (see FIG. 5: flow channel width is 78 mm, flow channel maximum height is 60 mm), which has a cross section area smaller than that on an upstream side of the ascending flow channel 30 (see FIG. 3). In the present embodiment, as shown in FIG. 5, a top surface of the shrunk part 36 is formed in a convex upward shape at a central region in a right and left direction, with regard to the cross section perpendicular to the flow direction of the ascending flow channel 30.

The substantially horizontal wall surface 34 (top surface) of the enlarged part 32 and the top surface of the shrunk part 36 are smoothly continuous (or connected) in order for the cross section shape of the ascending flow channel 30 to smoothly transit from the enlarged part 32 to the shrunk part 36. In the shrunk part 36, the cross section area is constant (see FIG. 5). The cross section area in a region from a downstream end of the enlarged part 32 to an upstream end of the shrunk part 36 is smaller than that on the upstream side of the ascending flow channel 30 (see FIG. 3) and larger than that of the shrunk part 36 (see FIG. 5).

The bottom surface from the enlarged part 32 to the shrunk part 36 has a substantially constant cross section shape (see FIGS. 4 and 5). Thus, the bottom surface of the ascending flow channel 30 is smoothly formed from the upstream end to the downstream end of the ascending flow channel 30.

In addition, in the present embodiment, on the way of the descending flow channel 40, there is formed a second enlarged part 42 (see FIG. 6: flow channel width is 83 mm, flow channel maximum height is 119 mm), which has a cross section area larger than that of the enlarged part 32. This configuration prevents a siphon phenomenon in the descending flow channel 40.

From a downstream end of the shrunk part 36 (the downstream end of the ascending flow channel 30) to an upstream end of the second enlarged part 42, a top surface and a bottom surface of the descending flow channel 40 are respectively smoothly continuous in order for the cross section area of the descending flow channel 40 to smoothly increase.

<Operation>

Next, an operation (action) of the washdown flush toilet according to the present embodiment is explained.

In order to perform a flush, the operation lever or button (not shown) in an operation panel (not shown) is operated so that the discharge valve (not shown) provided in the reservoir tank 4 is opened. Then, a predetermined amount of the flush water (for example, 3.8 liters) is supplied from the reservoir tank 4 into the water conduit 20 of the main toilet unit 2 through the supply port 2*a* provided on the rear side of the main toilet unit 2.

Subsequently, the flush water supplied to the water conduit 20 flows through the main water-guiding portion 21 to be branched into the first rim water-guiding portion 23*a* and the second rim water-guiding portion 23*b*.

The flush water spouted from the first spouting portion 24*a* through the first rim water-guiding portion 23*a* flows onto the rim water-passage bottom surface 25 to circulate at the upper part of the bowl part 8, and then swirls down from the rim water-passage bottom surface 25 toward the waste receiving surface 16 to wash the bowl part 8.

The flush water spouted from the second spouting portion 24*b* through the second rim water-guiding portion 23*b* also flows onto the rim water-passage bottom surface 25 to circulate at the upper part of the bowl part 8, and then swirls down from the rim water-passage bottom surface 25 toward the waste receiving surface 16 to wash the bowl part 8.

The flush water swirled down while washing the bowl part 8 is discharged from the water discharge trap conduit 14 along with the waste.

Herein, according to the washdown flush toilet 1 of the present embodiment, with regard to the cross section perpendicular to the flow direction of the ascending flow channel 30, a portion on the downstream side of the ascending flow channel 30 is provided with the enlarged part 32, which has a cross section area larger than that on the upstream side of the ascending flow channel 30, and a downstream end of the ascending flow channel 30 (and an upstream side of the descending flow channel 40) is provided with the shrunk part 36, which has a cross section area smaller than that on the upstream side of the ascending flow channel 30.

According to this feature, when the washdown flush toilet 1 is operated (flushed), the flush water along with the waste flows into the trap ascending pipe part 14*a* of the water discharge trap conduit 14, and separation of the waste (breakup of a mass) is promoted in the enlarged part 32 whose cross section area is larger, as shown in FIG. 7. Subsequently, in the shrunk part 36 whose cross section area is smaller, the waste and the flush water which have been spread in the enlarged part 32 are collected again to effectively flow. According to these actions, effective waste discharging performance can be maintained even with a relatively smaller amount of flush water.

In addition, according to the washdown flush toilet 1 of the present embodiment, the enlarged part 32 is enlarged on the upper side of the ascending flow channel 30.

According to this feature, when the washdown flush toilet 1 is operated (flushed), the flush water along with the waste flows into the trap ascending pipe part 14*a* of the water discharge trap conduit 14, and a part of the flush water flows into the upper enlarged area of the enlarged part 32 whose cross section area is larger (enlarged) on the upper side. Due to this action of the flush water, the waste passing the enlarged part 32 can be given a rotational force as shown by arrows in FIG. 8, so that the waste can rotate in such a direction (vertical rotational direction) that the waste can climb up the highest reachable position B of the ascending flow channel 30. According to these actions, the waste discharging performance can be enhanced more even with a relatively smaller amount of flush water.

In addition, according to the washdown flush toilet 1 of the present embodiment, the upstream end A of the top surface of the enlarged part 32 is located above the highest reachable position B of the bottom surface of the ascending flow channel 30.

According to this feature, the cross section area of the ascending flow channel 30 is maintained constant for a longer region of the ascending flow channel 30, so that potential energy by the flush water's falling down may be used more efficiently (with less loss).

In addition, according to the washdown flush toilet 1 of the present embodiment, the flow channel height of the shrunk part 36 is lower than the flow channel height on the upstream side of the ascending flow channel 30. That is to say, the cross section area of the shrunk part 36 is shrunk in the vertical direction.

According to this feature, the direction in which the cross section area is enlarged in the enlarged part 32 and the direction in which the cross section area is shrunk in the shrunk part 36 are the same, so that the waste and the flush water which have been spread in the enlarged part 32 are effectively collected in the shrunk part 36 to smoothly flow. This also contributes to the enhancement of the waste discharging performance.

In addition, according to the washdown flush toilet 1 of the present embodiment, a portion of the top surface of the enlarged part 32 of the ascending flow channel 30 is formed by the substantially vertical wall surface 33 extending in a substantially vertical direction from the upstream end A.

According to this feature, the rotational force as shown by the arrows in FIG. 8 can be given to the waste more effectively, In addition, according to the washdown flush toilet 1 of the present embodiment, with regard to the cross section perpendicular to the flow direction of the ascending flow channel 30, a portion of the top surface of the enlarged part 32 of the ascending flow channel 30 is formed by the substantially horizontal wall surface 34 which has a convex upward shape.

According to this feature, even though the cross section area of the ascending flow channel 30 is larger in the enlarged part 32, it can be effectively prevented that the flow of the flush water and the waste in the enlarged part 32 is disturbed excessively.

In addition, according to the washdown flush toilet 1 of the present embodiment, with regard to the cross section perpendicular to the flow direction of the ascending flow channel 30, the top surface of the shrunk part 36 has a convex upward shape.

According to this feature, the top surface of the ascending flow channel 30 (and the descending flow channel 40) can be smoothly formed from the enlarged part 32 to the shrunk part 36, so that the waste and the flush water which have been spread in the enlarged part 32 can be effectively collected to smoothly flow. This also contributes to the enhancement of the waste discharging performance.

In addition, according to the washdown flush toilet 1 of the present embodiment, with regard to the cross section perpendicular to the flow direction of the descending flow channel 40, a portion on the downstream side of the descending flow channel 40 is provided with the second enlarged part 42 which has a cross section area larger than that of the enlarged part 32.

According to this feature, it is possible to prevent a siphon phenomenon in the descending flow channel 40.

What is claimed is:

1. A washdown flush toilet comprising:

a bowl part configured to receive waste, and a water discharge trap conduit connected to a lower portion of the bowl part, wherein the water discharge trap conduit includes:

an inlet pipe part whose one end is continuous or connected to the lower portion of the bowl part;

a trap ascending pipe part whose one end is continuous or connected to the other end of the inlet pipe part and which forms an ascending flow channel; and a trap descending pipe part whose one end is continuous or connected to the other end of the trap ascending pipe part and which forms a descending flow channel, with regard to a cross section perpendicular to a flow direction of the ascending flow channel, a portion on a downstream side of the ascending flow channel is provided with an enlarged part which has a cross section area larger than that on an upstream side of the ascending flow channel, and a downstream end of the ascending flow channel and/or an upstream side of the descending flow channel is provided with a shrunk part which has a cross section area smaller than that on the upstream side of the ascending flow channel, with regard to the cross section perpendicular to the flow direction of the ascending flow channel, at least a portion at a central region in a right and left direction of a top surface of the enlarged part of the ascending flow channel has a convex upward shape, with regard to the cross section perpendicular to the flow direction of the ascending flow channel or the descending flow channel, at least a portion at a central region in a right and left direction of a top surface of the shrunk part has a convex upward shape, and a bottom surface from the enlarged part to the shrunk part has a constant horizontal cross section shape, the convex upward shape at the central region in the right and left direction of the top surface of the enlarged part has a curvature greater than a curvature at a central region in the right and left direction of the bottom surface of the enlarged part, with regard to a cross section perpendicular to a flow direction of the enlarged part, a gap between right and left surfaces of the enlarged part is widened from the bottom surface of the enlarged part toward the top surface of the enlarged part, and the trap descending pipe part has a region that extends diagonally downward, whose bottom surface is in a straight shape as seen from a lateral direction.

2. The washdown flush toilet according to claim 1, wherein at least a portion of a top surface of the enlarged part of the ascending flow channel is formed by a wall surface extending in a vertical direction.

3. The washdown flush toilet according to claim 1, wherein with regard to a cross section perpendicular to a flow direction of the descending flow channel, a portion on a downstream side of the descending flow channel is provided with a second enlarged part which has a cross section area larger than that of the enlarged part.

4. The washdown flush toilet according to claim 1, wherein the shrunk part has the cross section area smaller than that adjacent to the enlarged part on the upstream side of the ascending flow channel.

* * * * *